US011591820B2

(12) United States Patent
Chu et al.

(10) Patent No.: US 11,591,820 B2
(45) Date of Patent: Feb. 28, 2023

(54) SUNSHADE TENT

(71) Applicant: Yotrio Group Co., Ltd., Linhai (CN)

(72) Inventors: Jiehua Chu, Linhai (CN); Zhi Sun, Linhai (CN); Jianqiang Xie, Linhai (CN); Scott Adam Garrison, Fitchburg, WI (US)

(73) Assignee: Yotrio Group Co., Ltd., Linhai (CN)

( * ) Notice: Subject to any disclaimer, the term of this patent is extended or adjusted under 35 U.S.C. 154(b) by 68 days.

(21) Appl. No.: 17/169,419

(22) Filed: Feb. 6, 2021

(65) Prior Publication Data

US 2021/0396038 A1 Dec. 23, 2021

(30) Foreign Application Priority Data

Jun. 22, 2020 (CN) ..... 202010575117.8
Jun. 22, 2020 (CN) ..... 202021168286.1
Jun. 22, 2020 (CN) ..... 202021169910.X
Jun. 22, 2020 (CN) ..... 202021169912.9

(51) Int. Cl.
*E04H 15/44* (2006.01)
*E04H 15/60* (2006.01)
*E04H 15/64* (2006.01)
*A45B 23/00* (2006.01)

(52) U.S. Cl.
CPC ..... *E04H 15/60* (2013.01); *E04H 15/44* (2013.01); *E04H 15/64* (2013.01); *A45B 2023/0093* (2013.01)

(58) Field of Classification Search
CPC ..... E04H 15/52; E04H 15/44; E04H 15/34; E04H 15/18
See application file for complete search history.

(56) References Cited

U.S. PATENT DOCUMENTS 490,205 A * 1/1893 Lauber ..... E04H 15/18 52/63
1,560,110 A * 11/1925 Skog ..... E04H 15/00 135/117
2,723,673 A * 11/1955 Call ..... E04H 15/46 135/147
5,115,828 A * 5/1992 Spaulding ..... E04H 15/34 135/160
5,450,703 A * 9/1995 Fuhrman ..... E04H 15/34 52/843
7,207,344 B2 * 4/2007 Wu ..... E04H 15/58 135/160

(Continued)

*Primary Examiner* — Noah Chandler Hawk
(74) *Attorney, Agent, or Firm* — Jingman (James) Cai; SAC Attorneys LLP

(57) ABSTRACT

A sunshade tent includes a frame assembly and sheet assemblies. The frame assembly includes legs, first and second rafters. Each of the legs include a first connection mechanism, horizontal connecting members configured to be fixedly attached to a first end of each of the legs, and a mounting base positioned proximal a second end of each of the legs. The first rafters are detachably attached to a corresponding one of the legs via the first connection mechanism at an inclination relative to the horizontal connecting members. At least one of the second rafters is fixedly attached to a corresponding one of the horizontal connecting members via second interlocking elements. Each of the sheet assemblies include grooves for detachably attaching to a corresponding one of the second rafters via first interlocking elements.

7 Claims, 13 Drawing Sheets

(56) References Cited

U.S. PATENT DOCUMENTS

| | | | | |
|---|---|---|---|---|
| 7,308,901 | B2 * | 12/2007 | Meyer | E04H 15/50 135/117 |
| 7,628,164 | B2 * | 12/2009 | Joen-an Ma | E04H 15/44 135/121 |
| 9,243,422 | B2 * | 1/2016 | Hunt | E04H 15/18 |
| 9,556,639 | B2 * | 1/2017 | Hunt | E04H 15/02 |
| 10,202,783 | B2 * | 2/2019 | Pan | E04H 15/58 |
| 10,392,821 | B2 * | 8/2019 | Volin | E04B 1/19 |
| 11,230,857 | B2 * | 1/2022 | Yang | E04H 15/44 |
| 2005/0284037 | A1 * | 12/2005 | Merritt | E04H 15/44 52/82 |
| 2007/0215191 | A1 * | 9/2007 | Huang | E04H 15/44 135/131 |
| 2013/0145719 | A1 * | 6/2013 | Tseng | E04H 15/18 52/655.1 |
| 2020/0181936 | A1 * | 6/2020 | Zhu | B41F 16/0046 |

* cited by examiner

SUNSHADE TENT

CROSS-REFERENCE TO RELATED APPLICATIONS

This application claims priority to and the benefit of the following patent applications filed in National Intellectual Property Administration, People's Republic of China: patent application no. 202021169910.X, filed on Jun. 22, 2020 titled "A Connecting Structure of Sunshade Tent Foot Tube and Quadrangle Inclined Tube Connecting Part"; Chinese patent application no. 202010575117.8, filed on Jun. 22, 2020 titled "A Sunshade Tent"; Chinese patent application no. 202021168286.1 filed on Jun. 22, 2020 titled "An Iron Sheet Connecting Structure of the Sunshade Tent"; and Chinese patent application no. 202021169912.9, filed on Jun. 22, 2020 titled "A Connecting Structure between the Middle Inclined Tube and the Iron Sheet". The specifications of the above referenced patent applications are incorporated herein by reference in their entirety.

BACKGROUND

Tents are generally temporary, makeshift, or portable structures supported on the ground for sheltering people from wind, rain, and sunlight. Typically, tents are made of canvas mounted on assembled components such as vertical poles, ridges, rafters/middle inclined tubes, and the like such that the individual components are easily detachable from each other and can be removed or replaced at any time. As such, tents are carried in the form of parts to the location where it must be erected and assembled on site, thereby requiring the use of various parts and tools. With the assistance of available personnel, a tent can be thus set up quickly and conveniently once the use method of all parts and the tent structure are known.

Existing tents on the market divide the foot tube or leg pole and rafters into separate components. The separation of the components results in assembly of these components requiring several parts and screws, which are more prone to loss or damage thereby preventing secure assembly of the tent. An apparatus, that has reduced number of individual components preventing loss and incorrect placement of parts when the product is packaged in addition to reducing assembly time and increasing the overall strength of the product, is desirable.

Moreover, during assembly of a tent having iron sheets functioning as the roofing component, several fasteners are required to be used for detachably mounting the iron sheets on the rafters of the tent. In such cases, deformation often occurs when fixing with screws and locking the iron sheets on the rafters or middle inclined tubes, which leads to the short life of iron sheet of tent ceiling. Furthermore, the mounted iron sheet may slide from the tent top if being arranged on the middle-inclined tubes directly, which endangers the personal safety of users.

Hence, there is a long felt but unresolved need for a sunshade tent that is easy to install resulting in reduced assembly time and has improved overall structural strength. Moreover, there exists a need for a sunshade tent that has reduced number of individual components preventing loss and incorrect placement of parts when the product is packaged.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

Embodiments according to the present disclosure address the above-mentioned need for a sunshade tent that is easy to install resulting in reduced assembly time and has improved overall structural strength. Moreover, certain embodiments of the present disclosure addresses the need for a sunshade tent, that has reduced number of individual components preventing loss and incorrect placement of parts when the product is packaged.

According to one embodiment of the present disclosure, the sunshade tent, disclosed herein, comprises a frame assembly and sheet assemblies, for example, iron sheet assemblies. The frame assembly comprises legs, first rafters, and second rafters. Each of the legs comprise a first connection mechanism, horizontal connecting members, and a mounting base. The first connection mechanism is provided at a first end of each of the legs. The horizontal connecting members are configured to be fixedly attached proximal to the first end of each of the legs. The mounting base is positioned proximal a second end of each of the legs. The first rafters are detachably attached to a corresponding one of the legs via the first connection mechanism. The first connection mechanism is configured to position the attached at least one of the first rafters at an inclination relative to the horizontal connecting members. Each of the second rafters comprise first interlocking elements and second interlocking elements such that at least one of the second rafters is fixedly attached to a corresponding one of the horizontal connecting members via second interlocking elements. Each of the sheet assemblies comprise a plurality of grooves such that each of the sheet assemblies are configured to detachably attach to a corresponding one of the second rafters via the first interlocking elements of the corresponding one of the second rafters.

The provision of the first connection mechanism at the top of the legs reduces the number of product parts and hardware, prevents missing parts, and incorrect placement of parts when the product is packaged, reduces assembly time for customers, and increases the overall strength of the product. The provision of the first interlocking elements on the second rafters fits the clamping part of the connecting groove so that the sheet assembly can be fixed on the second rafter. The clamping part is arranged on the connecting grooves in a concealed mode, which not only ensures the service life of sheet assembly but also enhances the aesthetic measure of the sunshade tent. When installing, the sheet assembly can be positioned well and not prone to falling off and resulting injury.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF THE INVENTION

In preparation for explaining the details of the present inventive disclosure, it is to be understood by the reader that the invention is not limited to the presented details of the construction, materials and embodiments as illustrated in the accompanying drawings, as the invention concepts are clearly capable of other embodiments and of being practiced and realized in various ways by applying the disclosure presented herein.

It should be noted that in this article, relational terms such as "first" and "second" are only used to distinguish one entity or operation from another, which does not require or imply that there is an actual relationship or order between the entity or operation. Moreover, the term "comprise", "contain" or other variations is intended to cover non-exclusive inclusion so that a process, method, article or device covering a series of elements not only includes those elements, but also other elements not explicitly listed, or the elements inherent to such process, method, article or device. Therefore, in the case without more restrictions, the elements limited by the statement "comprise a . . . " do not exclude the existence of other identical elements in the process, method, article, or device.

The present innovation is exemplarily described above in conjunction with the drawings, and it is obvious that the implementation of the present innovation is not limited by the above methods. As long as the various improvements made by the method concept and technical scheme of the present innovation are adopted, or the method concept and technical scheme of the present innovation are directly applied to other occasions without improvement, all fall within the protection scope of the present innovation. The specific implementation modalities of the present innovation will be further described in detail below in conjunction with the drawings to make the technical scheme of the present innovation easier to understand and master.

Figure 1A:
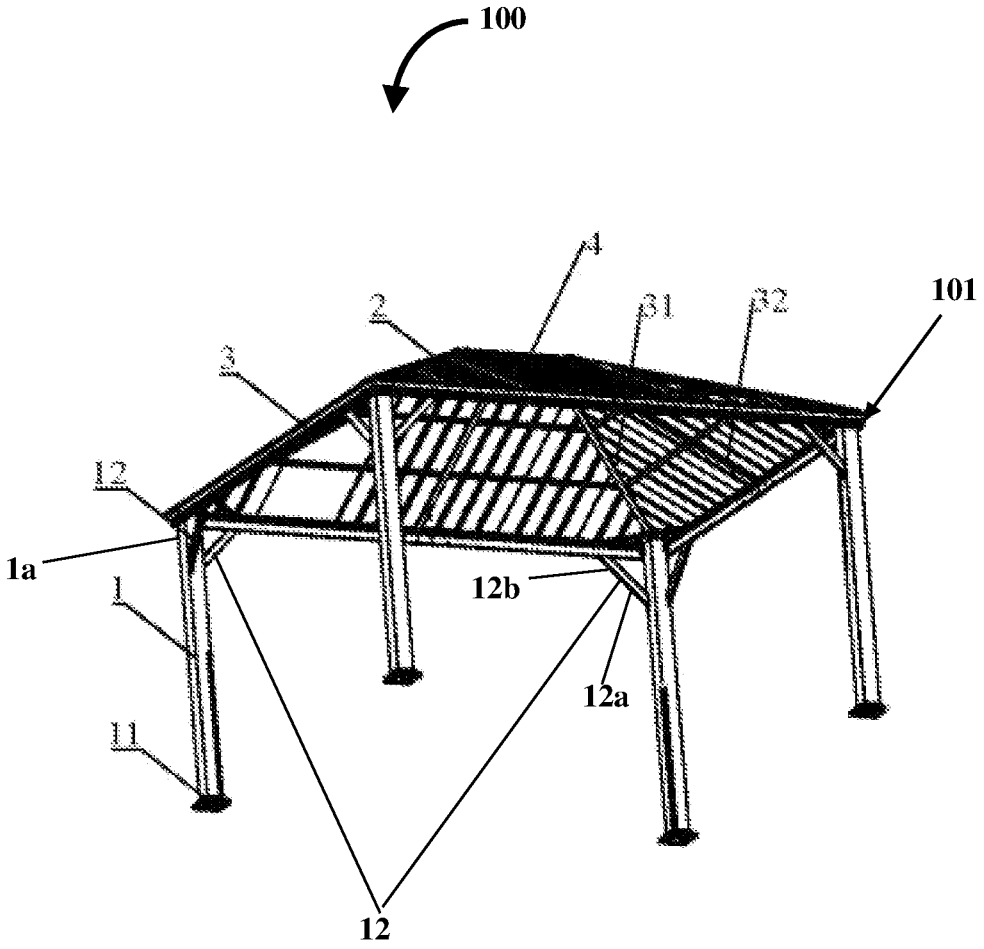
FIG. 1A exemplarily illustrates a perspective view of an embodiment of a sunshade tent.

FIG. 1A exemplarily illustrates a perspective view of an embodiment of a sunshade tent 100 according to the present disclosure. The sunshade tent, disclosed herein, comprises a frame assembly 101 and iron sheet assemblies 2, hereafter referred to as sheet assemblies 2. The sheet assemblies 2 are made of iron, steel, other metals, alloys, composite material, etc. The frame assembly comprises legs 1, first rafters 31, and second rafters 32. Each of the legs 1 comprise a first connection mechanism (exemplarily illustrated in FIGS. 3B-3C), horizontal connecting members 3, and a mounting base 11. The first connection mechanism is provided at a first end of each of the legs 1. The horizontal connecting members 3 are configured to be fixedly attached proximal to the first end of each of the legs 1. The mounting base 11 is positioned proximal a second end of each of the legs 1. The first rafters 31 are detachably attached to a corresponding one of the legs 1 via the first connection mechanism. The first connection mechanism is configured to position the attached at least one of the first rafters 31 at an inclination relative to the horizontal connecting members 3. In an embodiment, the sunshade tent 100 further comprises stabilizer bars 12. The stabilizer bars 12 are arranged proximal to the top end 1*a* of the legs 1 such that one end 12*a* of stabilizer bar 12 is arranged on a leg 1 tube, and the other end 12*b* is arranged on either a rafter 31 or a horizontal connecting member 3.

Figure 1B:
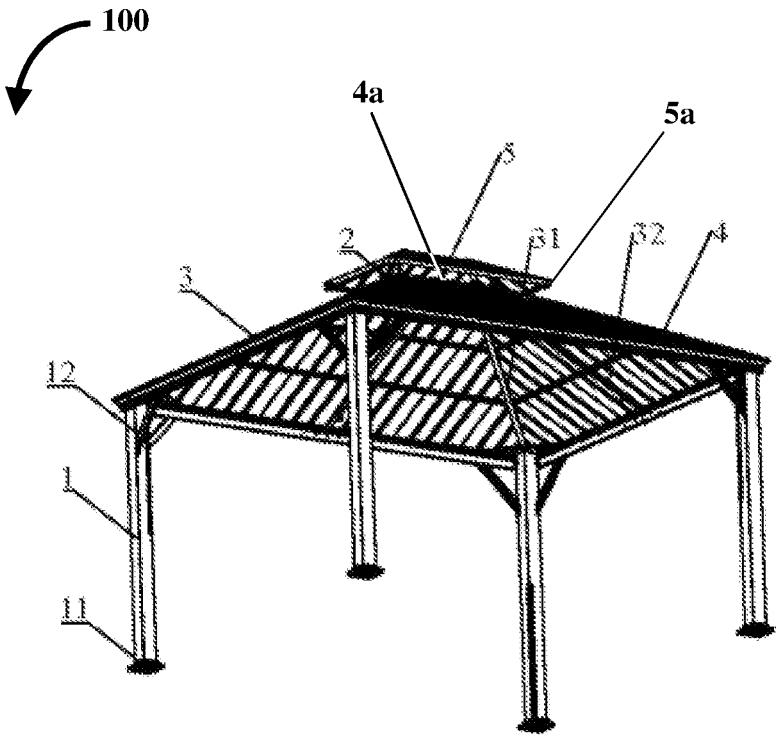
FIG. 1B exemplarily illustrates a perspective view of another embodiment of the sunshade tent according to the present disclosure.

FIG. 1B exemplarily illustrates a perspective view of another embodiment of the sunshade tent 100 according to the present disclosure. As illustrated in FIG. 1B, the sunshade tent 100 further comprises an opening 4*a* arranged above a first ceiling 4 such that a second ceiling 5 is arranged on the opening 4*a* and a gauge is arranged between the first ceiling 4 and the second ceiling 5. As used herein, the "gauge" refers to a distance or a vertical height between the first ceiling 4 and the second ceiling 5. In an embodiment, the vertical height is measured between the inclined rafters of the first ceiling 4 and the second ceiling 5. In an embodiment of the present disclosure, the distance or gauge between the first ceiling 4 and the second ceiling is about 160 mm.

Figure 1C:
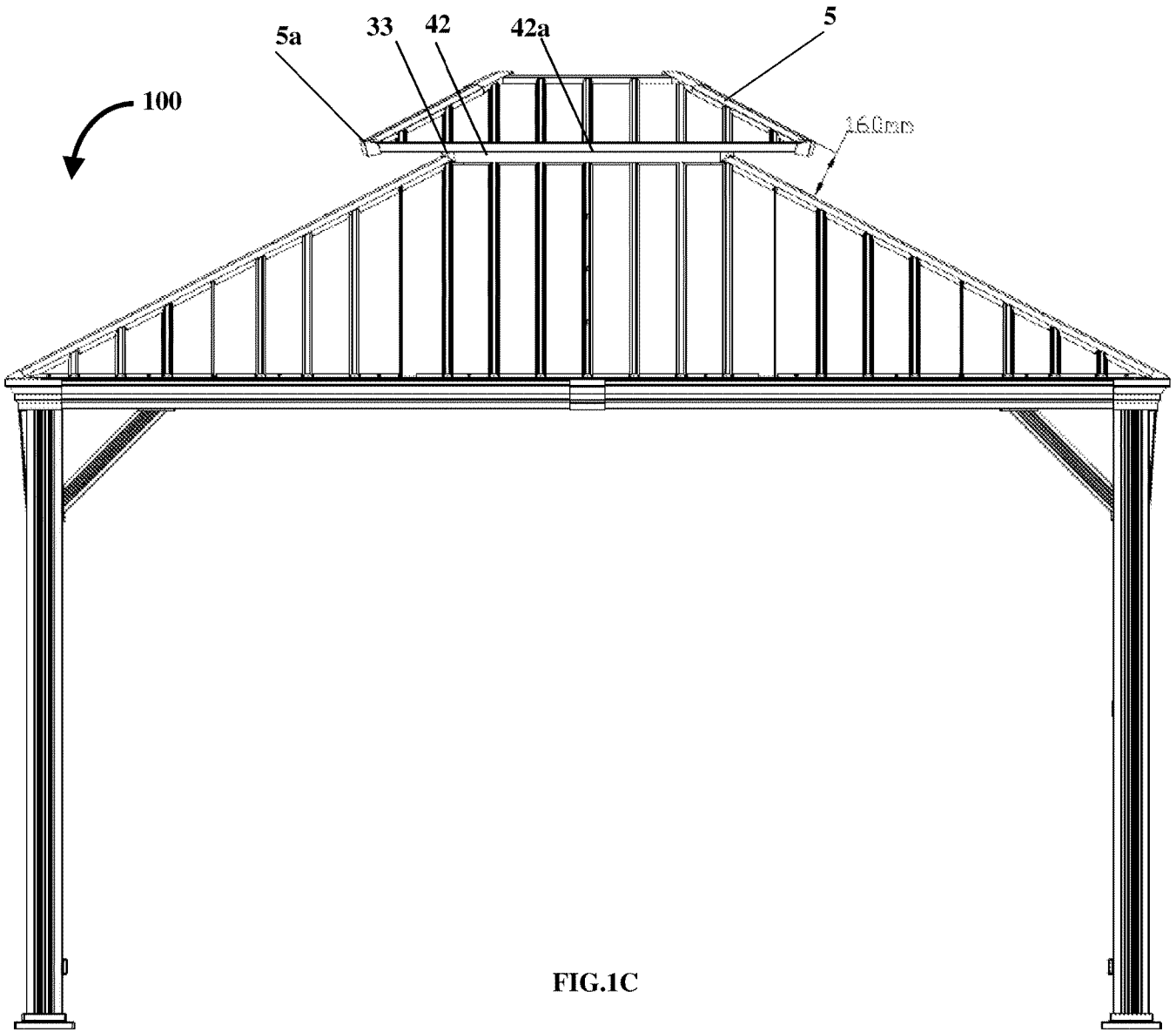
FIG. 1C exemplarily illustrates a front view of the embodiment of the sunshade tent according to the present disclosure.
Figure 2:
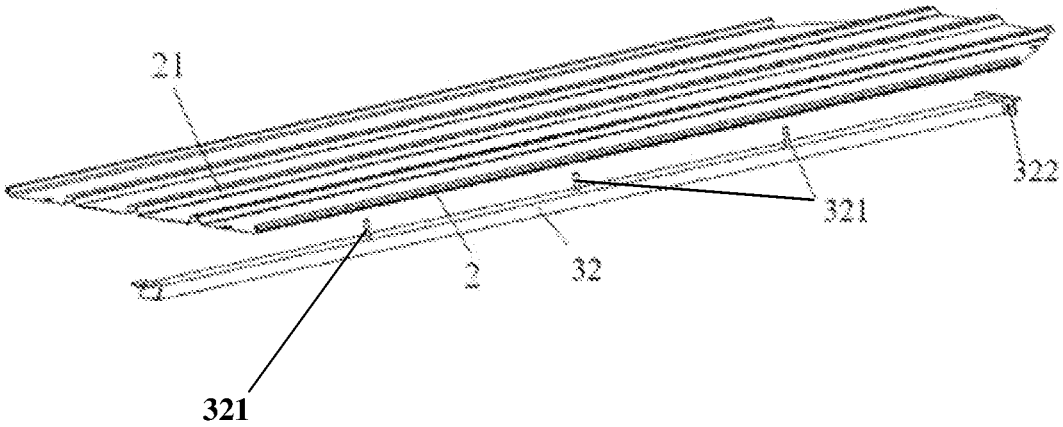
FIG. 2 exemplarily illustrates an exploded view of a sheet assembly of the sunshade tent shown in FIG. 1.

FIG. 2 exemplarily illustrates an exploded view of a sheet assembly 2 of the sunshade tent shown in FIG. 1. Each of the second rafters 32 comprise first interlocking elements 321 and second interlocking elements 322 such that at least one of the second rafters 32 is fixedly attached to a corresponding one of the horizontal connecting members 3 via second interlocking elements 322. Each of the sheet assemblies 2 comprise a plurality of grooves 21 such that each of the sheet assemblies 2 are configured to detachably attach to a corresponding one of the second rafters 32 via the first interlocking elements 321 of the corresponding one of the second rafters 32. In an embodiment, the first interlocking elements 321 comprise a cylindrical pin, a screw, a bolt, etc. In an embodiment, the first interlocking elements 321 are welded onto the second rafter 32. In another embodiment, the first interlocking elements 321 extend from the second rafter 32 as an integral part of the second rafter 32. The first interlocking elements 321 fit the clamping part of the connecting groove 21 so that the sheet assembly 2 can be fixed on the second rafter 32. The clamping part is arranged on the connecting grooves 21 in a concealed mode, which not only ensures the service life of sheet assembly 2 but also enhances the aesthetic measure of the tent. When installing, the sheet assembly 2 can be positioned well and the sheet assembly 2 will not be prone to falling off and result in an injury.

Figure 3A:
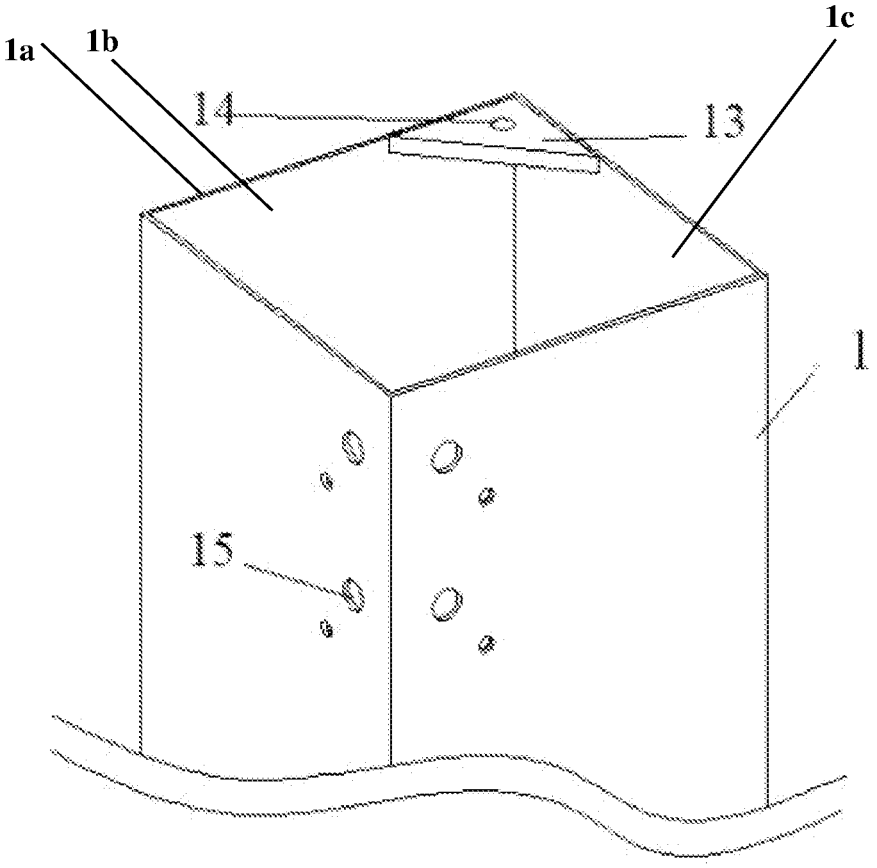
FIG. 3A exemplarily illustrates a perspective view of a leg of the sunshade tent shown in FIG. 1.
Figure 3B:
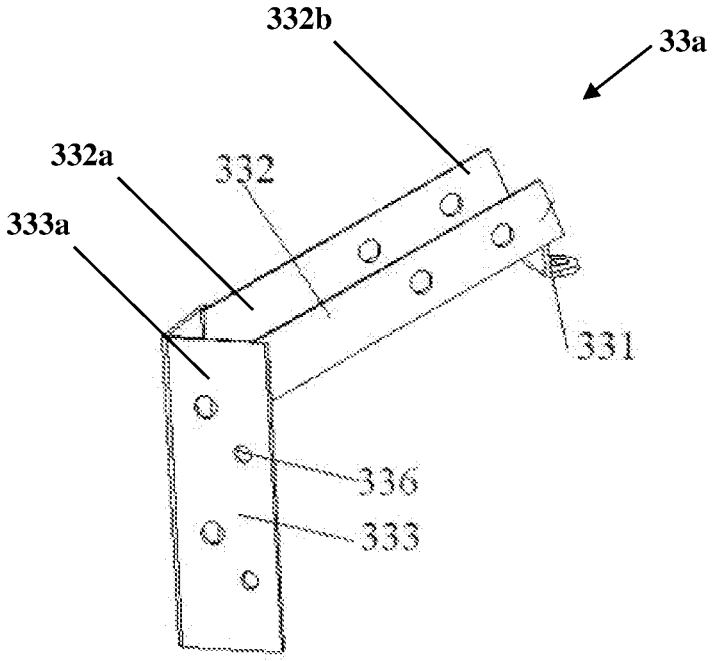
FIG. 3B exemplarily illustrates a perspective view of a first connection mechanism of the sunshade tent shown in FIG. 1.
Figure 3C:
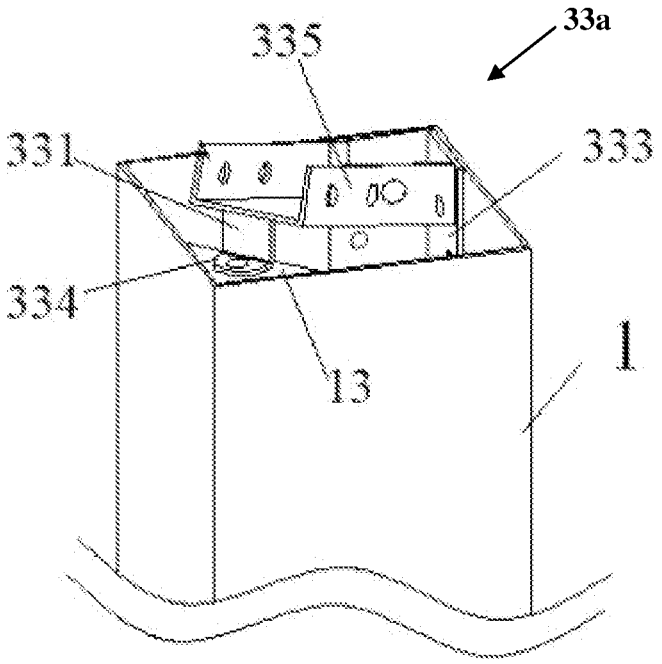
FIG. 3C exemplarily illustrates a perspective view of a first connection mechanism inserted into a leg of the sunshade tent shown in FIG. 1.

FIG. 3A exemplarily illustrates a perspective view of a leg 1 of the sunshade tent 100 shown in FIG. 1. FIG. 3B exemplarily illustrates a perspective view of a first connection mechanism 33*a* of the sunshade tent 100 shown in FIG. 1. The first connection mechanism 33*a* is, for example, a quadrangle inclined tube connecting part, as shown in FIGS. 3B and 3C. FIG. 3C exemplarily illustrates a perspective view of a first connection mechanism 33*a* inserted into a leg 1 of the sunshade tent 100 shown in FIG. 1. As illustrated in FIGS. 3A and 3C, each of the legs 1 are of a hollow cuboidal configuration further comprising a mounting plate 13 affixed at a top end 1*a* of the legs 1, between adjacent first sidewalls 1*b* and 1*c* of the legs 1. The mounting plate 13 comprises a first mounting hole 14. Moreover, the second sidewalls of the legs 1 comprise a plurality of second mounting holes 15. The first connection mechanism 33*a* further comprises a first brace member 333, a second brace member 332, and an attachment member 331. A first end 333*a* of the first brace member 333 is fixedly arranged at the bottom 332*a* of the second brace member 332. The attachment member 331 is an L-shaped connector attached to a top end 332*b* of the second brace member 332.

The first brace member 333 comprises a plurality of third mounting holes 336 configured to align with the second mounting holes 15 of the legs 1 such that the first brace member 333 is configured to be fastened to the second sidewalls of the legs 1. The second brace member 332 is configured to extend from the first brace member 333 for receiving at least one of the first rafters 31. The second brace member 332 is positioned at an inclination relative to the first brace member 333 such that the second brace member 332 comprises a plurality of fourth mounting holes 335 for receiving fasteners configured to restrain movement of the received at least one of the first rafters 31. When assembled, the inclination of the second brace member 332 relative to the first brace member 333 ensures the first rafters 32 are positioned in an upwardly inclined orientation relative to the horizontal ground surface. The attachment member 331 comprises a fifth mounting hole 334 configured to align with the first mounting hole 14 of the mounting plate 13 for fastening the attachment member 331 to the mounting plate 13 using one or more fasteners.

Figure 4A:
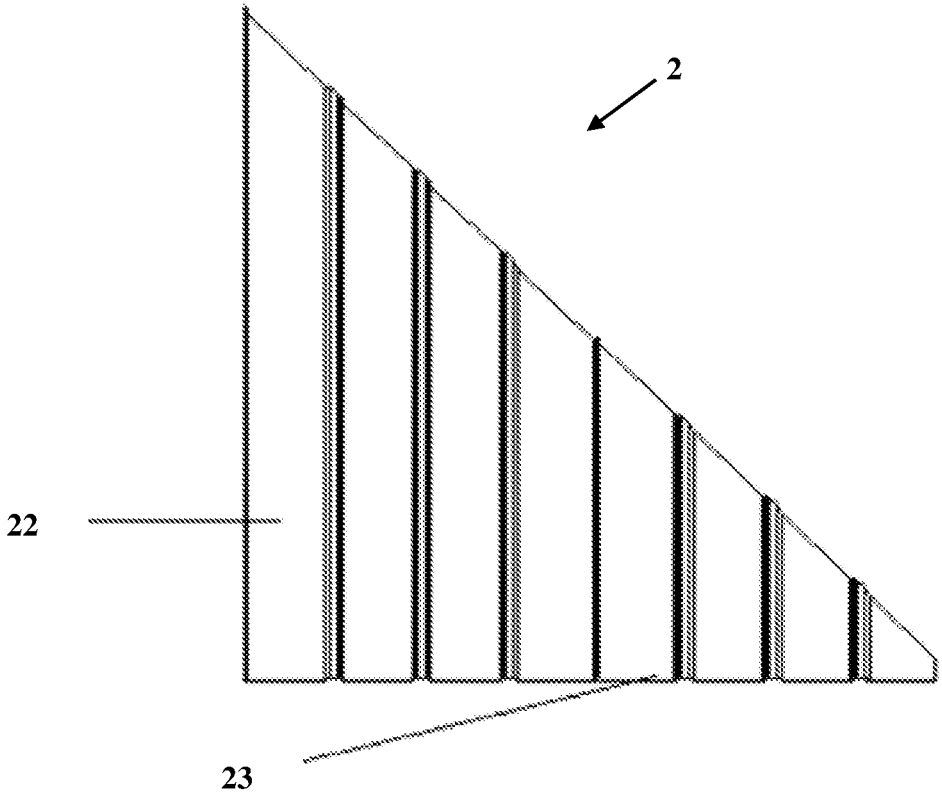
FIG. 4A exemplarily illustrates a top plan view of the sheet assembly of the sunshade tent shown in FIG. 1.

FIG. 4A exemplarily illustrates a top plan view of a sheet assembly 2 of the sunshade tent shown in FIG. 1. The sheet assembly 2 comprises a plurality of first sheets 22 and second sheets 23. The sheet assembly 2 of the sunshade tent 100 is connected through a slide-in connecting structure. It comprises the first sheet 22 and the second sheet 23 clamped on the side of the first iron sheet 22. The first sheets 22 are connected with the second sheets 23 to form the first ceiling 4 of the sunshade tent 100. The slide-in connecting structure of the sheet assembly 2 on the top of sunshade tent better prevents the sheet assembly 2 from falling off without affecting the functions of the tent, ensure the tent stability, increase the waterproof and safety performance and reduce the use of screws during traditional operation.

Figure 4B:
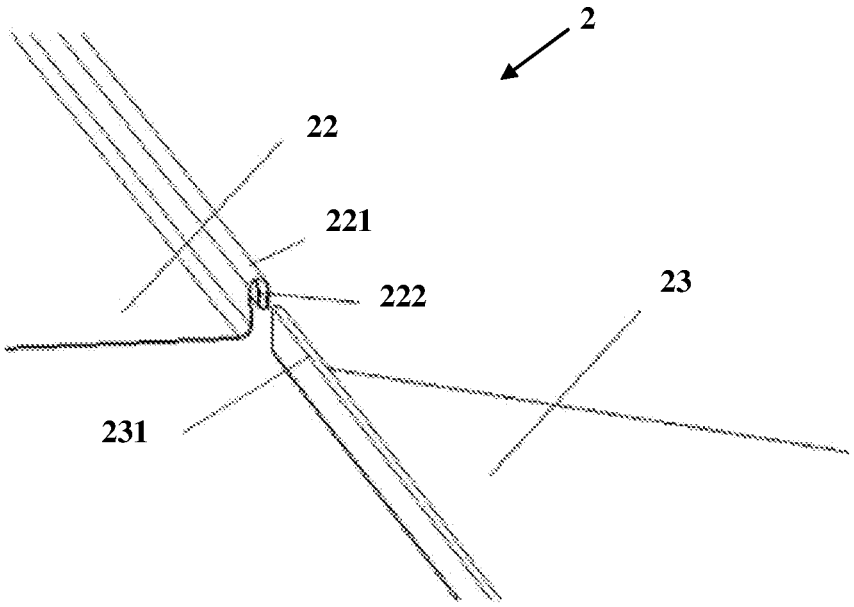
FIG. 4B exemplarily illustrates a front elevation view of an embodiment of a clamping mechanism of the sheet assembly shown in FIG. 4A.
Figure 4C:
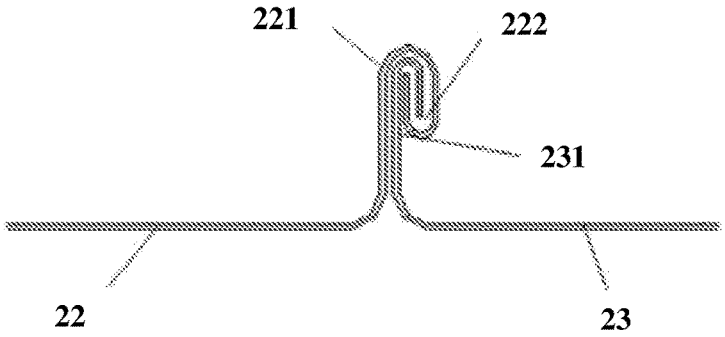
FIG. 4C exemplarily illustrates a front elevation view of an embodiment of a clamping mechanism of the sheet assembly shown in FIG. 4A.
Figure 4D:
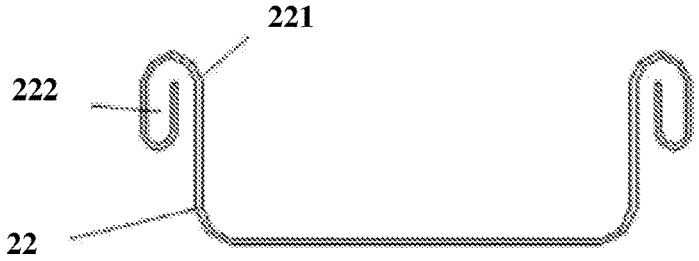
FIG. 4D exemplarily illustrates a front elevation view of an embodiment of a clamping mechanism of the sheet assembly shown in FIG. 4A.
Figure 4E:
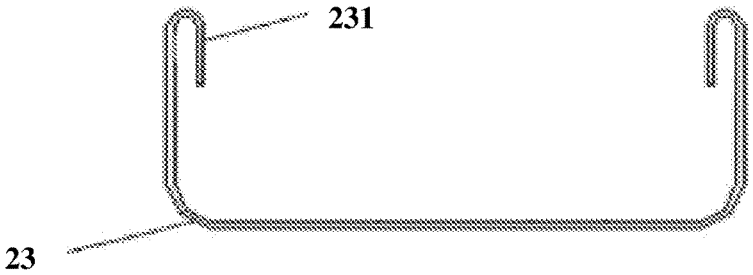
FIG. 4E exemplarily illustrates a front elevation view of an embodiment of a clamping mechanism of the sheet assembly shown in FIG. 4A.

FIG. 4B exemplarily illustrates a front elevation view of an embodiment of a clamping mechanism of the sheet assembly 2 shown in FIG. 4A. FIG. 4C exemplarily illustrates a front elevation view of an embodiment of a clamping mechanism of the sheet assembly 2 shown in FIG. 4A. FIG. 4D exemplarily illustrates a front elevation view of an embodiment of a clamping mechanism of the sheet assembly 2 shown in FIG. 4A. FIG. 4E exemplarily illustrates a front elevation view of an embodiment of a clamping mechanism of the sheet assembly shown in FIG. 4A. The first clamping part 221 is arranged on both sides of the first sheet 22. The first clamping part 221 is an outward-bending arc structure, and first clamping groove 222 is arranged on the end portions of the first clamping part 221. The second clamping part 231 is arranged on both sides of the second sheet 23. The second clamping part 231 is an outward-bending arc structure and smaller than the first clamping part 221. The first clamping part 221 and the second clamping part 231 constitute a slide-in connecting structure. The second clamping part 231 of the second sheet 23 is inserted into the first clamping groove 222 of the first clamping part 221 and connects the first sheet 22 and the second sheet 23 together. The first sheet 22 and the second sheet 23 are connected through the slide-in connecting structure, which can better prevent the sheets 22 and 23 from falling off without affecting the functions of the tent, ensure the tent stability, increase the waterproof and safety performance and reduce the use of screws.

Figure 4F:
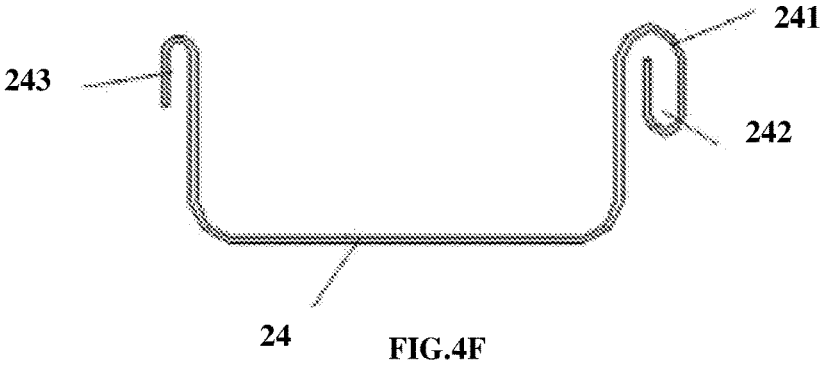
FIG. 4F exemplarily illustrates a front elevation view of an embodiment of a clamping mechanism of the sheet assembly shown in FIG. 4A.

FIG. 4F exemplarily illustrates a front elevation view of an embodiment of a clamping mechanism of the sheet assembly 2 shown in FIG. 4A. The sheet assembly 2 of the sunshade tent 100 is connected through the slide-in connecting structure. The sheet assembly 2 of the sunshade tent 100 comprises a plurality of third sheets 24. A third clamping part 241 is arranged on one side of the third sheet 24, and fourth clamping part 243 is arranged on the other side. Both the third clamping part 241 and the fourth clamping part 243 are of an outward-bending arc structure. The third clamping part 241 is larger than the fourth clamping part 243. Third clamping groove 242 is arranged on the third clamping part 241. The fourth clamping part 243 is clamped in the third clamping groove 242 so that two pieces of third sheet 34 are connected through the slide-in connecting structure, which can prevent sheet assembly 2 from falling off without affecting the functions of the tent, ensure the tent stability, increase the waterproof and safety performance and reduce the use of screws.

Figure 5A:
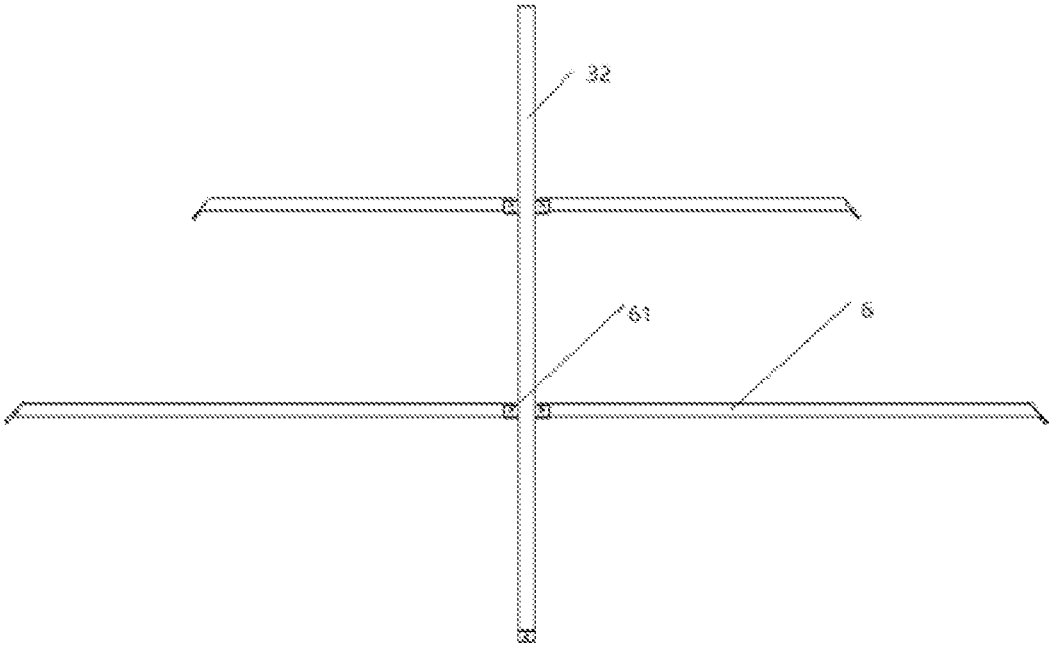
FIG. 5A exemplarily illustrates an alternative embodiment of the second rafter comprising foldable cross tubes where the cross tubes are folded away from the second rafter.
Figure 5B:
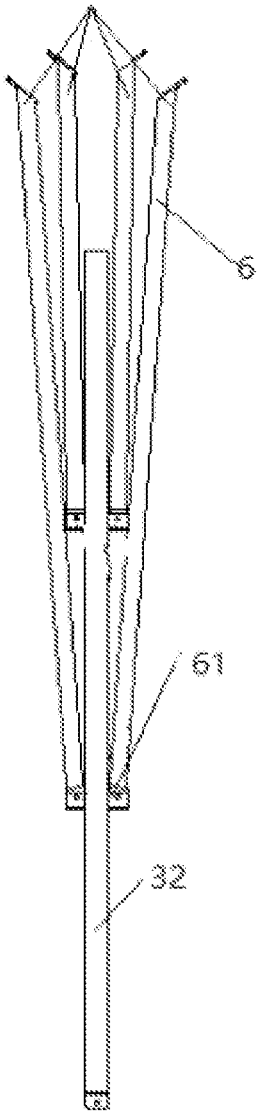
FIG. 5B exemplarily illustrates the alternative embodiment of the second rafter showing the cross tubes folded towards the second rafter.

FIG. 5A exemplarily illustrates an alternative embodiment of the second rafter 32 comprising foldable cross tubes 6 where the cross tubes 6 are folded away from the second rafter 32. FIG. 5B exemplarily illustrates the alternative embodiment of the second rafter 32 showing the cross tubes 6 folded towards the second rafter 32. The first ceiling 4 of the sunshade tent 100 is provided with cross tubes 6. Cross tube connecting part 61 is provided on the end portions of the cross tube 6, and the cross tube 6 is connected on the second rafter 32 in a rotating mode through the cross-connecting part 61.

Figure 6B:
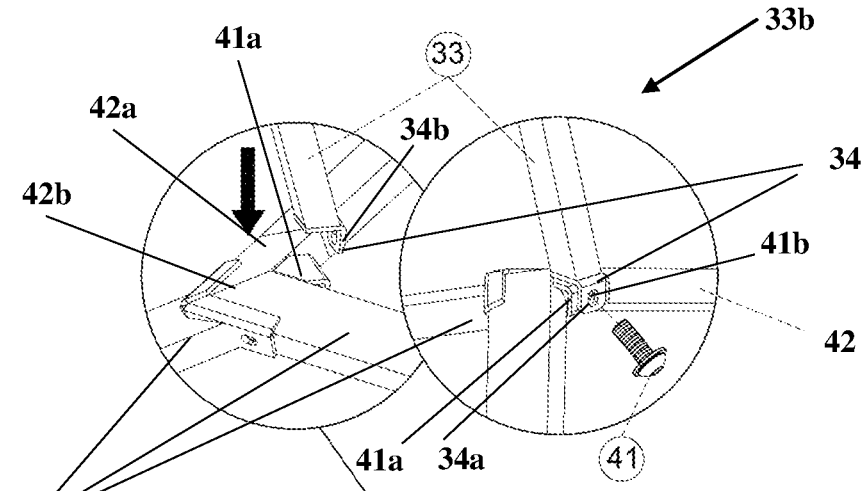
FIG. 6B exemplarily illustrates a second connection mechanism provided to detachably mount a second ceiling on the first ceiling of the sunshade tent.
Figure 6A:
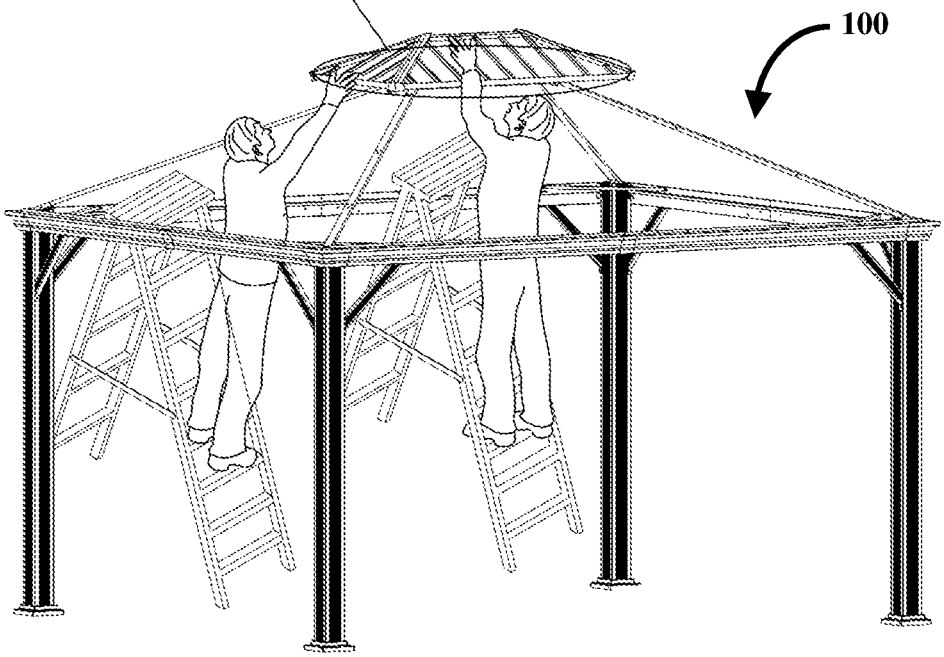
FIG. 6A exemplarily illustrates a second ceiling arranged on a first ceiling of the sunshade tent.

FIG. 6A exemplarily illustrates a second ceiling 5 arranged on the first ceiling 4 exemplarily illustrated in FIG. 1B. As disclosed earlier in the drawings and detailed description of FIG. 1B, a gauge is arranged between the first ceiling 4 and the second ceiling 5. As used herein, the "gauge" refers to a distance or a vertical height provided between the first ceiling 4 and the second ceiling 5, for example, about 160 mm.

FIG. 6B exemplarily illustrates a second connection mechanism 33*b* provided to detachably mount the second ceiling 5 on the first ceiling 4. In an embodiment, the second connection mechanism 33*b* comprises a frame 5*a* for mounting the second ceiling 5 on the first ceiling 4. The frame 5*a* comprises four corners comprising an inclined supporting leg 33 projecting downwards from each of the corners, as illustrated in FIG. 6B. Each of the inclined supporting leg 33 is attached to the second ceiling 5. The second ceiling 5 comprises a plurality of horizontal mounting members 42, as illustrated in FIGS. 1C and 6B. Each of the horizontal mounting members 42 is arranged to form a frame 42*a* around the opening 4*a* i.e., one end of a horizontal mounting member 42 is attached to an adjacent horizontal mounting member 42. In an embodiment, the frame 42*a* formed by the horizontal mounting members 42 is of a similar shape as that of the frame 5*a*. In an embodiment, the frame 42*a* is of a square shape as shown in FIGS. 1C and 6B. Each of the inner corners 42*b* formed in the frame 42*a* by attaching one end of a horizontal mounting member 42 to an adjacent horizontal mounting member 42, each comprise a bracket 41*a*, as shown in FIG. 6B. The bracket 41*a* comprises a threaded hole 41*b* that is oriented at an angle that is equidistant from the adjacent horizontal mounting member 42, as shown in FIG. 6B. The inclined supporting legs 33 each comprise an L-shaped bracket 34 comprising a hole 34*a*. The L-shaped bracket 34 is attached to an end of the inclined supporting leg 33 such that one leg of the bracket comprising the hole 34*a* extends along the length of the inclined supporting leg 33. The inclined supporting legs 33 are each fastened to the bracket 41*a* using fasteners 41. The fasteners 41 pass through the hole 34*a* in the L-shaped bracket 34 of the inclined supporting leg 33 and in to the threaded hole 41*b* of the bracket 41*a* to secure the inclined supporting leg 33 to the L-shaped bracket 34.

The foregoing examples have been provided merely for explanation and are in no way to be construed as limiting of the sunshade tent 100 disclosed herein. While the sunshade tent 100 has been described with reference to various embodiments, it is understood that the words, which have been used herein, are words of description and illustration, rather than words of limitation. Furthermore, although the sunshade tent 100 has been described herein with reference to particular means, materials, and embodiments, the sunshade tent 100 is not intended to be limited to the particulars disclosed herein; rather, the sunshade tent 100 extends to all functionally equivalent structures, methods and uses, such as are within the scope of the appended claims. While multiple embodiments are disclosed, it will be understood by those skilled in the art, having the benefit of the teachings of this specification, that the sunshade tent 100 disclosed herein is capable of modifications and other embodiments may be effected and changes may be made thereto, without departing from the scope and spirit of the sunshade tent 100 disclosed herein.

We claim:

1. A sunshade tent comprising:

a frame assembly comprising:

a plurality of legs, wherein each of the legs are of a hollow cuboidal configuration, and wherein each of the legs comprise:

a first connection mechanism arranged at a first end of each of the legs;

horizontal connecting members configured to be fixedly attached proximal to the first end of each of the legs;

a mounting base positioned proximal a second end of each of the legs;

a mounting plate affixed between adjacent first sidewalls of the legs, the mounting plate comprising a first mounting hole; and second sidewalls of the legs comprising a plurality of second mounting holes;

a plurality of first rafters, wherein at least one of the first rafters is detachably attached to a corresponding one of the legs via the first connection mechanism, and wherein the first connection mechanism is configured to position the attached at least one of the first rafters at an inclination relative to the horizontal connecting members; and a plurality of second rafters, wherein at least one of the second rafters is fixedly attached to a corresponding one of the horizontal connecting members; and sheet assemblies, wherein each of the sheet assemblies comprises a plurality of grooves, and wherein each of the sheet assemblies is configured to detachably attach to a corresponding one of the second rafters.

2. The sunshade tent of claim 1, wherein the first connection mechanism further comprises:

a first brace member comprising a plurality of third mounting holes configured to align with the second mounting holes of the legs, wherein the first brace member is configured to be fastened to the second sidewalls of the legs;

a second brace member configured to extend from the first brace member for receiving at least one of the first rafters, the second brace member positioned at an inclination relative to the first brace member, wherein the second brace member comprises a plurality of fourth mounting holes for receiving fasteners configured to restrain movement of the received at least one of the first rafters; and an attachment member comprising a fifth mounting hole configured to align with the first mounting hole of the mounting plate, wherein the attachment member is fastened to the mounting plate.

3. The sunshade tent of claim 1, wherein each of the sheet assemblies comprise a plurality of first sheets slidably engaged with a plurality of second sheets using a slide-in connecting structure, wherein the slide-in connecting structure comprises a first clamping part and a second clamping part, wherein the second clamping part of the second sheet is inserted into a first clamping groove of the first clamping part and connect the first sheet and the second sheet together, thereby preventing the sheet assemblies from falling off, without affecting functioning of the sunshade tent, thereby ensuring stability of the sunshade tent, thereby increasing waterproofing and safety performance of the sunshade tent, and reducing use of screws for assembling the sunshade tent.

4. The sunshade tent of claim 3, wherein the sheet assemblies further comprise a plurality of third sheets, wherein each of the plurality of third sheets comprise a third clamping part arranged on one side of the third sheet, and a fourth clamping part arranged on the other side of the third sheet, wherein the third clamping part and the fourth clamping part are of an outward-bending arc structure, wherein the third clamping part is larger than the fourth clamping part, wherein a third clamping groove is arranged on the third clamping part, wherein the fourth clamping part is clamped in the third clamping groove, whereby two pieces of the third sheet are connected through the slide-in connecting structure, thereby preventing the sheet assemblies from falling off, without the affecting of the functioning of the sunshine tent, thereby ensuring the stability of the sunshade tent, thereby increasing the waterproofing and safety performance of the sunshade tent, and reducing the use of screws.

5. The sunshade tent of claim 1, wherein the detachable attachment of each of the sheet assemblies to a corresponding one of the second rafters comprise interlocking elements originating from the second rafters, and wherein the interlocking elements function to position the sheet assemblies in a correct placement and further function to hold the sheet assemblies in place, thereby freeing hands of a user during assembly of the sunshade tent.

6. A sunshade tent comprising:

a frame assembly comprising:

a plurality of legs, each of the legs comprising:

a first connection mechanism arranged at a first end of each of the legs;

horizontal connecting members configured to be fixedly attached proximal to the first end of each of the legs; and a mounting base positioned proximal a second end of each of the legs;

a plurality of first rafters, wherein at least one of the first rafters is detachably attached to a corresponding one of the legs via the first connection mechanism, and wherein the first connection mechanism is configured to position the attached at least one of the first rafters at an inclination relative to the horizontal connecting members; and a plurality of second rafters, wherein at least one of the second rafters is fixedly attached to a corresponding one of the horizontal connecting members, wherein each of the second rafters comprise first interlocking elements and second interlocking elements, wherein the at least one of the second rafters is fixedly attached to the corresponding one of the horizontal connecting members via the second interlocking elements; and sheet assemblies, wherein each of the sheet assemblies comprises a plurality of grooves, wherein each of the sheet assemblies is configured to detachably attach to a corresponding one of the second rafters, wherein each of the sheet assemblies are configured to detachably attach to the corresponding one of the second rafters via the first interlocking elements of the corresponding one of the second rafters, wherein the first interlocking elements are (a) welded onto the second rafters, or (b) extend from the second rafters as an integral part of the second rafters, and wherein the first interlocking elements fit into a clamping part of the grooves to facilitate fixing of the sheet assemblies on the second rafters.

7. A sunshade tent comprising:

a frame assembly comprising:

a plurality of legs, each of the legs comprising:

a first connection mechanism arranged at a first end of each of the legs;

horizontal connecting members configured to be fixedly attached proximal to the first end of each of the legs; and a mounting base positioned proximal a second end of each of the legs;

a plurality of first rafters, wherein at least one of the first rafters is detachably attached to a corresponding one of the legs via the first connection mechanism, and wherein the first connection mechanism is configured to position the attached at least one of the first rafters at an inclination relative to the horizontal connecting members; and a plurality of second rafters, wherein at least one of the second rafters is fixedly attached at a hinge location to at least one first rafter, wherein the plurality of second rafters are configured to be in a substantially parallel folded state to the at least one first rafter during transit, and wherein the plurality of second rafters unfold to a substantially perpendicular state to the at least one first rafter during assembly; and sheet assemblies, wherein each of the sheet assemblies comprises a plurality of grooves, and wherein each of the sheet assemblies are configured to detachably attach to a corresponding one of the second rafters, wherein each of the sheet assemblies are configured to detachably attach to the corresponding one of the second rafters via the first interlocking elements of the corresponding one of the second rafters, wherein the first interlocking elements are (a) welded onto the second rafters, or (b) extend from the second rafters as an integral part of the second rafters, and wherein the first interlocking elements fit into a clamping part of the grooves to facilitate fixing of the sheet assemblies on the second rafters.

* * * * *